United States Patent [19]

Field et al.

[11] Patent Number: 4,525,086

[45] Date of Patent: Jun. 25, 1985

[54] SOLENOID ACTUATED PIVOTAL PRINTER HAMMER MECHANISM

[75] Inventors: Thomas R. Field, Lexington; Frank M. Hughes, Paris; Iraj D. Shakib; Edward J. Vitek, Jr., both of Lexington, all of Ky.

[73] Assignee: International Business Machines Corporation, Armonk, N.Y.

[21] Appl. No.: 658,347

[22] Filed: Oct. 9, 1984

Related U.S. Application Data

[63] Continuation of Ser. No. 532,121, Sep. 14, 1983, abandoned.

[51] Int. Cl.[3] ..... B41J 1/08

[52] U.S. Cl. ..... 400/144.2; 400/157.2; 400/166; 101/93.48

[58] Field of Search ..... 400/144.2, 157.2, 166, 400/167; 101/93.03, 93.29, 93.32, 93.48

[56] References Cited

U.S. PATENT DOCUMENTS

| | | | |
|---|---|---|---|
| 3,651,916 | 3/1972 | Becchi | 400/157.2 X |
| 3,805,941 | 4/1974 | Cattaneo | 400/157.2 |
| 4,232,975 | 11/1980 | Kane | 400/144.2 |
| 4,327,639 | 5/1982 | Crystal et al. | 400/144.2 |
| 4,406,223 | 9/1983 | Curley | 400/144.2 |

FOREIGN PATENT DOCUMENTS

| | | | |
|---|---|---|---|
| 0028539 | 5/1981 | European Pat. Off. . | |
| 0065620 | 12/1982 | European Pat. Off. | 400/144.2 |
| 2336945 | 2/1974 | Fed. Rep. of Germany | 400/166 |
| 1206067 | 9/1970 | United Kingdom | 400/157.2 |

OTHER PUBLICATIONS

IBM Technical Disclosure Bulletin, "Uniform Impact Impression," by Bear, vol. 8, No. 4, 1-62, pp. 2-3.

*Primary Examiner*—Edgar S. Burr
*Assistant Examiner*—John A. Weresh
*Attorney, Agent, or Firm*—Laurence R. Letson

[57] ABSTRACT

A print mechanism is described which has a constant current driven solenoid acting against an arch-shaped hammer to power the hammer through an arc of powered flight followed by an arc of free flight. The solenoid/hammer engagement point removes the solenoid to a position which does not obstruct print line visibility and the hammer rest position is withdrawn to improve print line visibility.

7 Claims, 5 Drawing Figures

SOLENOID ACTUATED PIVOTAL PRINTER HAMMER MECHANISM

This application is a continuation of application Ser. No. 532,121 filed 9-14-83, now abandoned.

This invention relates to printers and particularly to the printing mechanism of a daisy wheel printer.

BACKGROUND OF THE INVENTION

Typewriters have traditionally used type levers or spherical type elements. More recently typewriters have begun using the daisy wheel print element which requires a hammer to be fired and impacted against the individual petals of the print wheel or daisy wheel to cause the print font on the petal of the wheel to impact against the printing ribbon and paper.

One drawback to the utilization of a daisy wheel type printer in a typewriter is that a typist needs print line visibility to observe what has just been typed. The close positioning of the type wheel to the print point diminishes print line visibility very substantially. Not only does the type wheel itself tend to block print line visibility, but also the ballistic hammer typically found in many daisy wheel printers must be positioned such that its trajectory intersects the plane of the print wheel at the print point, thereby further reducing print line visibility.

Alternative hammers utilized to impact the daisy wheel print petals occasionally use a lever acting against the hammer structure. While this is advantageous from the standpoint of reducing the hammer assembly size, the hammer itself is still positioned to substantially reduce visibility.

A lever hammer typically is activated by a magnet acting on one end which then forces the opposite end of lever into engagement with the print element petals. This type hammer may be subject to variations in magnetic field strength, poor magnetic efficiency, and high tolerance requirements. This type hammer relies upon the magnetic field strength to force the printing end of the hammer into engagement with the print petal.

The characteristic of the magnetic field forcing the hammer element into contact with and holding the petal onto the platen during the printing stroke is also characteristic of some of the ballistic hammer designs. In this type of hammer, the impact is dependent upon the voltage and the current at the point of impact.

SUMMARY OF THE INVENTION

An arch or horseshoe-shaped hammer, is described, in conjunction with its supports and drives. The horseshoe-shaped hammer mass distribution tends to concentrate the center of percussion near the impact point, thereby improving print dynamics.

The drive for the hammer is provided by a solenoid which is positioned between the pivot axis of the hammer and the impact point on the hammer head, thus allowing for a relatively short drive stroke with the commensurate multiplication of movement due to the different lever arm lengths of the impact point on the hammer and the drive is controlled by a constant current driver.

The horseshoe or arch-shape of the hammer together with the structure of the bar extending across the ends thereof provides a stable structure for transmitting the solenoid thrust to the hammer even though the solenoid thrust is applied off center.

DRAWINGS

Figure 3:
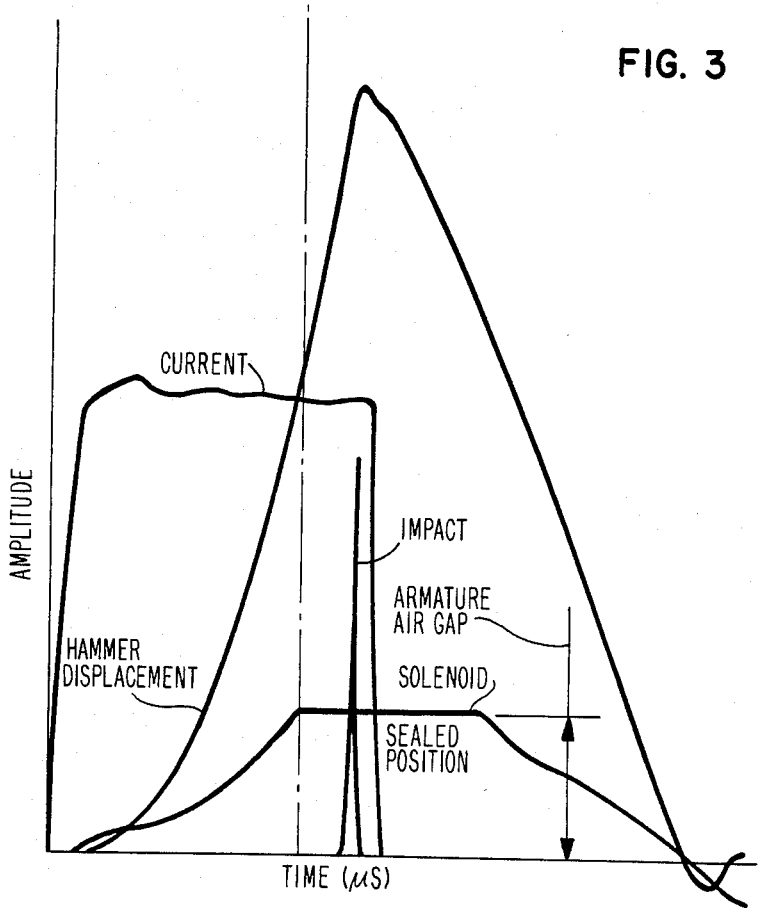

FIG. 3 displays traces representative of different variables found in the print mechanism.

Figure 4:
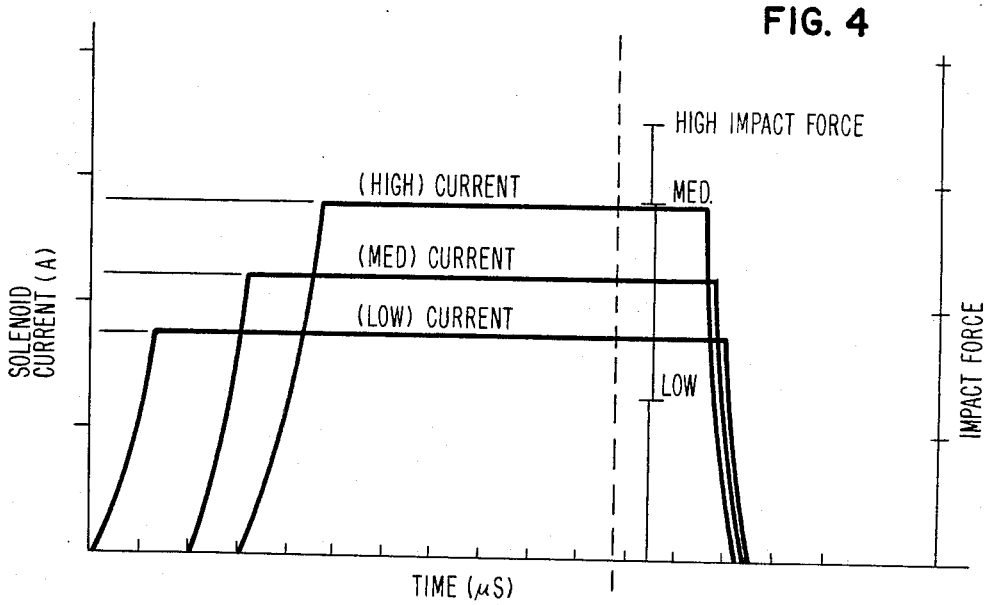

FIG. 4 represents the current flow in the solenoid for different impact levels.

Figure 5:
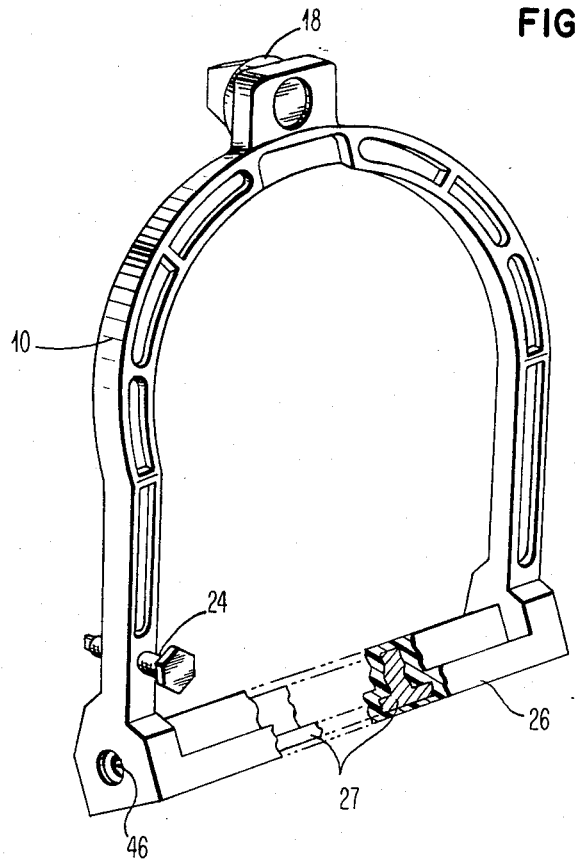

FIG. 5 illustrates the hammer construction per se.

Figure 1:
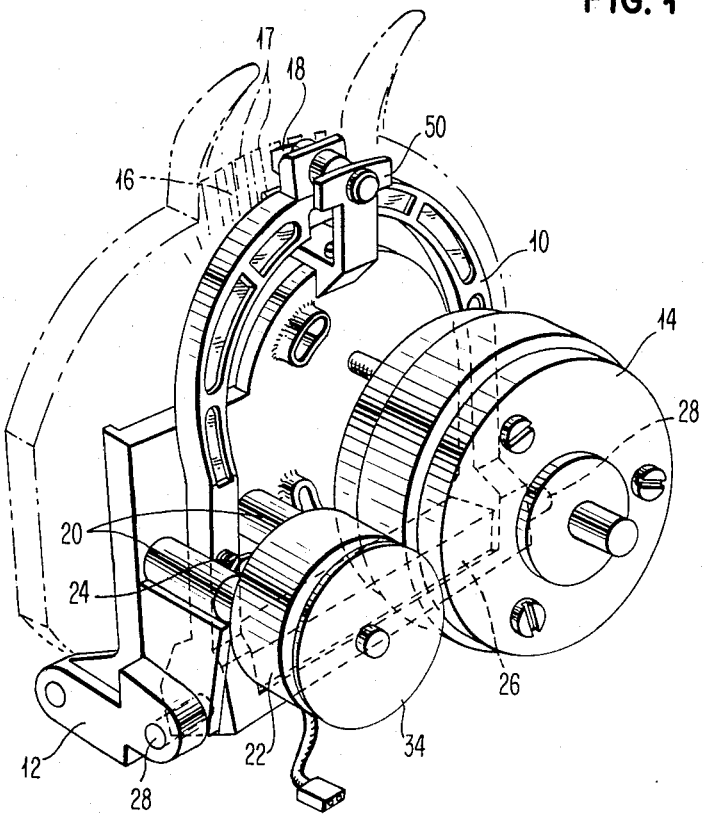
FIG. 1 is a perspective view of the print mechanism.

Referring to FIG. 1, hammer 10 is pivotallly supported on motor plate 12. Motor plate 12 also serves to support the drive motor 14 which in turn controls selection of the print element position. Print element 16 is the daisy wheel type being basically a flat disc having a series of petals 17 extending out from the center thereof and carrying on each petal 17 a character font. Motor 14 being directly coupled to the type element 16 causes the type element 16 to rotate and to position successive petals 17 in a position where the hammer head 18 may impact against the rear surface of the petals 17 of type element 16.

Supported on the motor plate 12 by standoffs 20 is the solenoid 22. Solenoid 22 acting through its armature 38 engages adjustable screw stop 24 which is threadedly engaged with one leg of the hammer 10. Stop 24 allows the control of powered flight duration by determining the throw of the armature 34 and armature tip 38 by adjusting the working stroke 31 with the hammer 10 resting against the stop 50. The screw is used as the adjustable means of setting the working stroke 31.

The pivot axis of hammer 10 is formed by a bar 26 extending between the two legs of the horseshoe-shaped hammer 10. The hammer 10 is supported by bullets 28 which are inserted through the motor plate and engaged with mating recesses in the bar 26. Bar 26 acts as a torque tube to transmit some of the torque exerted about the axis formed by bullets 28 to the other leg of hammer 10. Due to the rigidity of bar 26, an approximately equal force is then transmitted through both legs of the hammer 10 to the hammer head 18 minimizing torqueing of the hammer head. This acts to equalize the forces on both sides of the hammer head and at the same time reduce the flexing of the hammer structure.

Figure 2:
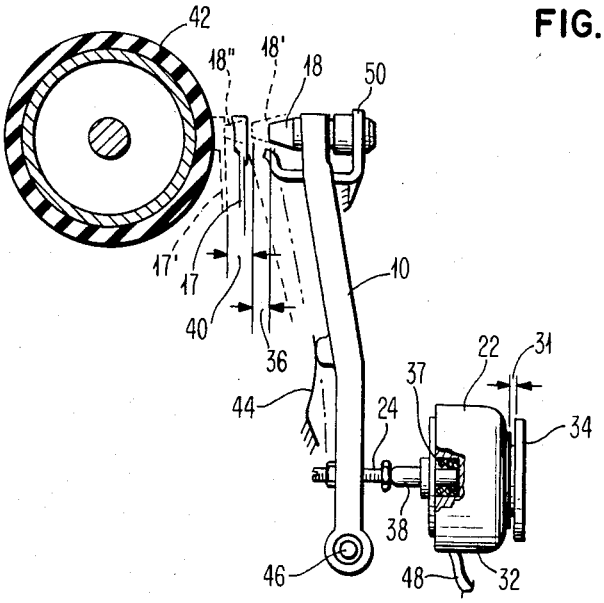
FIG. 2 is a left side view of the print mechanism illustrating powered flight and free flight of the hammer.

Referring to FIG. 2, the working stroke 31 between the armature 34 and the coil housing 32 of solenoid 22 may be adjusted by means of the screw stop 24. By extending screw stop 24 away from the hammer 10, the air gap 31 which defines the working stroke of the solenoid will increase. As the solenoid air gap 31 increases, the impact force of the hammer 10 for any particular electrical condition will likewise increase.

By observing the amount of possible movement between the armature 34 of the solenoid 22 and the coil housing 32 of the solenoid 22, it is seen that the amount of powered flight 36 of the hammer 10 is short compared to the distance to be traversed by the hammer head 18. The working stroke of the armature 38 of the solenoid 22 is limited by air gap 31 between armature 34 and coil housing 32. The armature tip 38 acts against the screw stop 24 which is located relatively close to the pivot axis of the hammer 10, defined by bullets 28. Therefore the powered flight of the hammer head 18 is approximately six times the movement of the armature tip 38. Typically, the hammer 10 and hammer head 18 move through an arc during each printing cycle, wherein approximately 60% of the flight through the arc is powered while the remaining approximately 40% is free flight 40, uncontrolled by engagement with the solenoid armature 38.

The advantage of the free flight 40 of the hammer 10 is significant inasmuch as the free flight 40 reduces the variations in impact between the hammer 10, the type element 16, and the platen 42. The impact level is not dependent upon the voltage applied to the solenoid 22 or to the current flow in the solenoid 22 at the point of impact inasmuch as the hammer 10 has disengaged from the armature tip 38 and is in free flight 40 toward the platen 42 before impact, based solely upon the momentum of the hammer 10 and the forces that have been previously transferred to the hammer 10 by the armature tip 38.

An additional benefit of utilizing the powered stroke 36 and free flight 40 arrangement of the hammer 10 as described is the fact that the hammer 10 may be retracted substantially from the platen, in its rest position, thereby improving the visibility of the print line.

Referring to FIG. 5, the main structure of the hammer 10 is fabricated from reinforced plastic type materials preferably a glass filled polycarbonate. In order to enhance the wear characteristics of the pivot points 46 and to obtain optimum striking force, the pivot points 46 are made of a steel or other wear resistant metal formed as sockets in bar 27 and then insert molded into the hammer 10 while the hammer head 18 is a relatively high density metal such as steel and likewise insert molded for permanent attachment.

In the preferred embodiment, the bar 26 extending across the two legs of the arch-shaped hammer 10 is formed and molded around a T-shaped cross sectional bar 27 which not only acts as the sockets for the povots 42 but also acts as a torsion tube such that the drive force transmitted by the armature tip 38 of the solenoid 22 to one leg of the hammer 10 is transmitted torsionally to the other leg of the hammer 10. In FIG. 5, the torsion tube 27 or T bar 27 is illustrated where the spanning bar material of polycarbonate has been removed for visibility.

After impact of the hammer head 18 against the type element 16 and platen 42, the primary restorative force for the hammer head 18 is rebound. A relatively tight spring member 44 may be utilized to retain the hammer 10 in its retracted position against stop 50. Not only does this properly position the hammer 10 for the next printing stroke but it further insures that the adjustable screw stop 24 is engaged with the end of the armature tip 38 and that the armature tip 38 of the solenoid 22 together with its permanently attached clapper 34 are moved away from the solenoid coil and thereby insures a uniform air gap 31 prior to solenoid activation. A light spring 37 inside of the solenoid biases the armature tip 38 against the adjustable screw 24.

The T bar 27 of the hammer 10 acts in an additional capacity of concentrating some of the mass of the hammer 10 below the pivots in the cross bar of the T. The effect of concentrating some of the mass below the pivots 46 tends to act to move the center of percussion away from the pivot axis and toward the line of impact which extends between the hammer 10 and the platen 42. It is desirable to move the center of percussion as closely as possible to the line of impact.

Inasmuch as the hammer is not the equivalent of a simple pendulum, it is very difficult to co-align the center of percussion and the line of impact. Therefore, compromises must be made in the interests of maintaining a relatively light weight hammer and due to space requirements, and the restriction on the amount of additional material that may be added to the hammer 10 at a sufficient radius from the pivot 42 to compensate for the center of percussion position.

Referring to FIG. 3, as the solenoid 22 is activated by impressing upon the terminals 48 thereof, a voltage, the current will begin to build in the solenoid 22 and the magnetic field will begin to build. As the field builds, the armature tip 38 begins to move and the armature tip 38 then pushes on the hammer causing it to begin its forward flight. As the current builds to a predetermined value, the hammer 10 will accelerate. As the predetermined current value is reached, the voltage to the solenoid 22 is chopped to insure that a constant current is maintained. In the event that the current deviates from the desired current level, the width of the voltage pulses is varied by a pulse width modulation control to return the current level to the desired level. Chopping of the voltage is a well known technique for maintaining constant current flow from a constant current drive.

The amount of current-on time exceeds that required to seal the solenoid 22. Thus, the solenoid 22 completes its working stroke under full current. This makes the hammer velocity at impact time independent of current decay characteristics and allows for less sensitivity to current-on time and driver voltage input.

Referring to FIG. 3, traces are displayed which represent the displacement of the solenoid armature tip 38, hammer, and the current level within the solenoid 22 together with hammer 10 velocity and a trace representing the impact of the hammer 10 on the platen 42. Portions of the curves which are to the right of the reference line are those events which occur after the solenoid armature seals and the hammer goes into free flight.

FIG. 4 illustrates the current levels which may be impressed upon the solenoid to control impact force. One of the current levels represented in FIG. 4 is selected to correspond to the impact level desired. The curves of FIG. 4 are idealized representations of the current curve of FIG. 3.

I claim:

1. A print mechanism for a printer comprising:

a print disc, a hammer for impacting a preselected point on said print disc, an electromagnetic driver for said hammer, said hammer comprising a rigid body formed in the shape of an arch, and having contacting means attached thereto at the midpoint thereof for contacting said disc, bearings supports formed into the legs of said arch, impact absorbing means attached to only one of said legs of said arch to accept impact drive forces from said electromagnetic driver, said impact absorbing means being radially displaced from said bearing supports by less than one-half the radial distance between said bearing supports and said contacting means, the drive output of said electromagnetic driver being transferred to said hammer and said hammer being driven toward said disc solely by said driver impacting said impact absorbing means and moving through the entirety of its range of motion.

2. The print mechanism of claim 1 wherein said hammer further comprises a bar spanning said arch.

3. The print mechanism of claim 2 wherein said bar comprises a rigid member rigidly attached to said arch for transmitting torque from one leg of said arch to the other leg of said arch.

4. The print mechanism of claim 1 wherein said impact absorbing means is adjustable with respect to said hammer for controlling the amount of powered flight of said hammer.

5. The print mechanism of claim 2 wherein said member is formed with a substantial portion of said member mass concentrated opposite from said contacting means with respect to said bearing supports.

6. The print mechanism of claim 1 wherein said electromagnetic drive comprises a solenoid.

7. The print mechanism of claim 6 wherein said solenoid is a constant current solenoid.

* * * * *